US006439916B1

(12) United States Patent
Kuo

(10) Patent No.: US 6,439,916 B1
(45) Date of Patent: Aug. 27, 2002

(54) ELECTRICAL ADAPTER

(75) Inventor: Chin Pao Kuo, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/014,615

(22) Filed: Dec. 10, 2001

(51) Int. Cl.[7] ..... H01R 13/627
(52) U.S. Cl. ..... 439/362; 439/638; 439/654
(58) Field of Search ..... 439/362–365, 439/638, 650, 655, 359

(56) References Cited

U.S. PATENT DOCUMENTS 3,963,300 A * 6/1976 Patton et al. ..... 439/638
4,215,326 A * 7/1980 Hollyday ..... 333/182
4,456,319 A * 6/1984 Poulain Ricros ..... 439/359
4,592,614 A * 6/1986 Myers, Jr. ..... 439/404
4,781,625 A * 11/1988 Yang ..... 439/654
5,123,859 A * 6/1992 Davis et al. ..... 439/405
5,306,175 A * 4/1994 Swanstrom ..... 439/362
5,348,494 A * 9/1994 Falossi et al. ..... 439/362
5,383,795 A * 1/1995 Falossi et al. ..... 439/362
6,116,942 A * 9/2000 Chen et al. ..... 439/362
6,176,743 B1 * 1/2001 Kuo ..... 439/638
6,296,534 B1 * 11/2001 Yi ..... 439/876
6,319,066 B2 * 11/2001 Kuo ..... 439/638
6,343,957 B1 * 2/2002 Kuo et al. ..... 439/638

* cited by examiner

*Primary Examiner*—P. Austin Bradley
*Assistant Examiner*—Ross Gushi
(74) *Attorney, Agent, or Firm*—Wei Te Chung

(57) ABSTRACT

An electrical adapter (1) comprises an insulative housing (10) having opposite first and second poles (14, 16), a first electrical connector (20) and a second electrical connector (30) fastened at the first and second poles, respectively. The second pole defines a slot (11) opened in a top face (162) and an inside face (164) thereof and a through hole (13) below and communicating with the slot. A screw member (40) is inserted into the slot from above of the second pole. Then, the screw member is pushed toward the first pole to lie down between the first and second poles. Finally, the screw member is pushed forward so that it extends beyond the second pole.

12 Claims, 6 Drawing Sheets

ELECTRICAL ADAPTER

BACKGROUND OF THE INVENTION

1. Field of the Invention

The present invention relates to an electrical adapter, and particularly to a digital visual interface (DVI) adapter which is used for interconnecting two different types of electrical connectors.

2. Description of the Prior Art

An electrical DVI adapter is widely used for interconnecting a monitor to a host computer in computer industry. The DVI adapter generally comprises a DVI connector which is adapted for mating with a complementary connector of a cable assembly connected with a monitor, and a D-sub connector which is adapted for mating with a mating connector mounted in a host computer, thereby electrically connecting the monitor to the host computer.

Referring to FIGS. 5 and 6, a conventional DVI adapter 5 includes a main housing 50, a shielded DVI connector 60 and a shielded D-sub connector 70 both integrally attached at opposite ends of the main housing 50. The main housing 50 has an elongate body portion 52, first and second lateral ends 54, 56 vertically extending from opposite ends of the elongate body portion 52, respectively, and the first and second lateral ends 54, 56 are connected with the DVI connector 60 and the D-sub connector 70, respectively. A pair of screw members 80 are adapted for insertion into corresponding threaded holes 58 defined in the second lateral end 56 to interlock with corresponding nuts of the mating connector. The screw member 80 is horizontally inserted into the space 55 defined by the elongate body 50, the first and second lateral ends 54, 56 beside the main housing 50. Then, the screw member 80 is screwed into a corresponding screw hole 58 until it extends beyond rear face 562 of the second lateral end 56 for engaging with a corresponding nut of the mating connector.

However, due to the rigid structure and size of the screw member 80, the space 55 must be large enough for insertion of the screw member such that the whole size of the adapter 5 is enlarged, which is disadvantageous for the miniature trend in computers.

Hence, an improved electrical adapter is required to overcome the disadvantages of the prior art.

BRIEF SUMMARY OF THE INVENTION

A first object of the present invention is to provide an improved electrical adapter having a compact structure.

A second object of the present invention is to provide an improved method of assembling a screw member with an electrical adapter device.

To fulfill the above-mentioned objects, an electrical adapter in accordance with the present invention comprises an insulative housing, a first electrical connector and a second electrical connector oppositely connected with the housing. The housing has an elongate body, first and second poles vertically extending from opposite ends of the elongate body. The second pole defines a slot opened in a top face and an inside face thereof and a through hole below and communicating with the slot. The first electrical connector is fastened on the first pole for mating with a complementary connector of a cable assembly connected with a monitor. The second electrical connector is connected with the second pole for engaging with a mating connector mounted in a host computer. A screw member is inserted into the slot from above of the second pole. Then, the screw member is pushed toward the first pole to lie down between the first and second poles. Finally, the screw member is rotated forward so that it extends beyond the second pole to interlock a corresponding nut of the mating connector.

Other objects, advantages and novel features of the invention will become more apparent from the following detailed description of the present embodiment when taken in conjunction with the accompanying drawings.

DETAILED DESCRIPTION OF THE INVENTION

Figure 1:
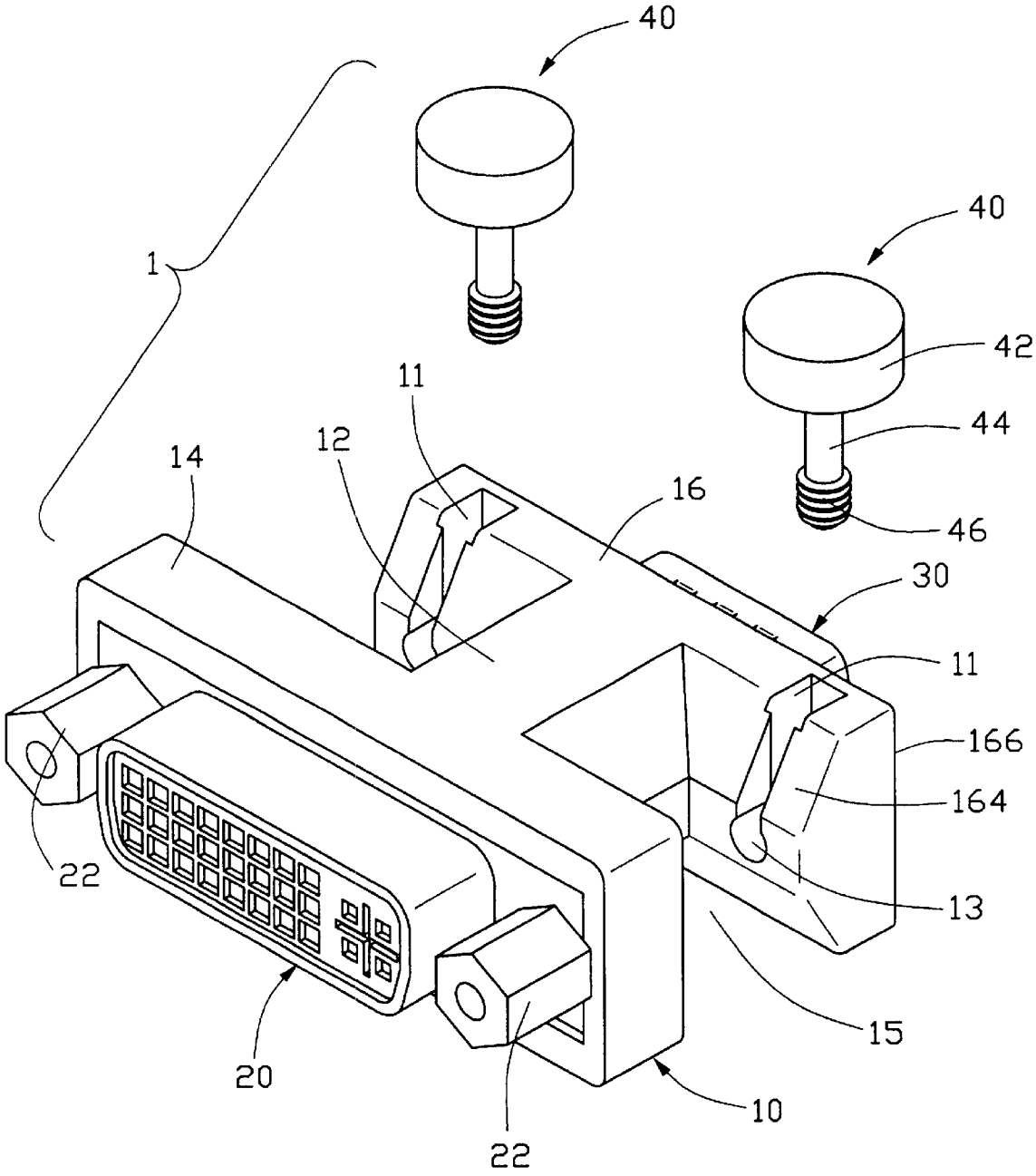
FIG. 1 is an exploded perspective view of an electrical adapter in accordance with the present invention.

Referring to FIG. 1 first, an electrical adapter 1 in accordance with the present invention is shown in an exploded perspective view and is used for interconnecting two different types of electrical connectors. The electrical adapter 1 comprises a dielectric main body 10, a first electrical connector 20 and a second electrical connector 30 integrally connected at opposite ends of the main body 10, and a pair of screw members 40 to be fastened to the main body 10.

The main body 10 is substantially shaped like character "I" and has an elongate body portion 12, a first pole 14 and a second pole 16 vertically extending from opposite ends of the body portion 12. The first and second poles 14, 16 are parallelly distanced from each other with a predetermined distance which is substantial equal to the whole length of each screw member 40. Additionally, a pair of slots 11 are defined in opposite sides of the second pole 16 and each is opened to a top face 162 and an inside surface 164 of the second pole 16. A through hole 13 is defined below and communicating with each slot 11 and extends through opposite inside and outside surfaces 164, 166 of the second pole 16 for receiving the screw member 40.

The first electrical connector 20 is a conventional DVI receptacle connector and is connected with the first pole 14 for mating with a complementary plug connector (not shown) connected with a cable assembly which is electrically connected with a monitor. The first electrical connector 20 has a pair of crewed nuts 22 on opposite sides thereof for interlocking with the complementary connector.

The second electrical connector 30 is general a conventional D-sub type connector known in the prior art, and is connected with the second pole 16 for mating with a mating connector mounted in a host computer, and thus the electrical adapter I electrically connects the monitor to the host computer through the first and second connectors 20, 30.

Figure 2:
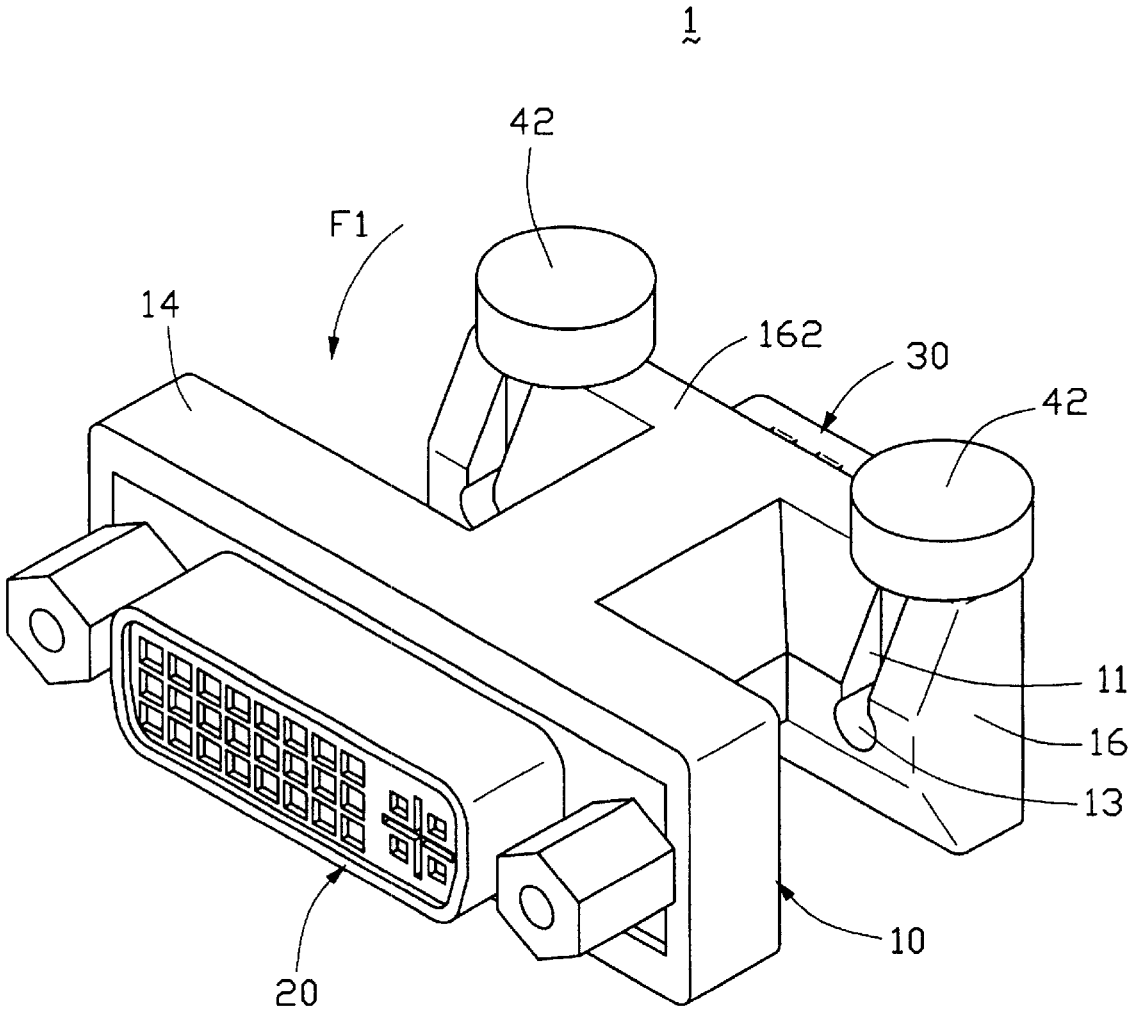
FIG. 2 is an assembled view of FIG. 1, wherein a screw member of the electrical adapter is in a first position.
Figure 3:
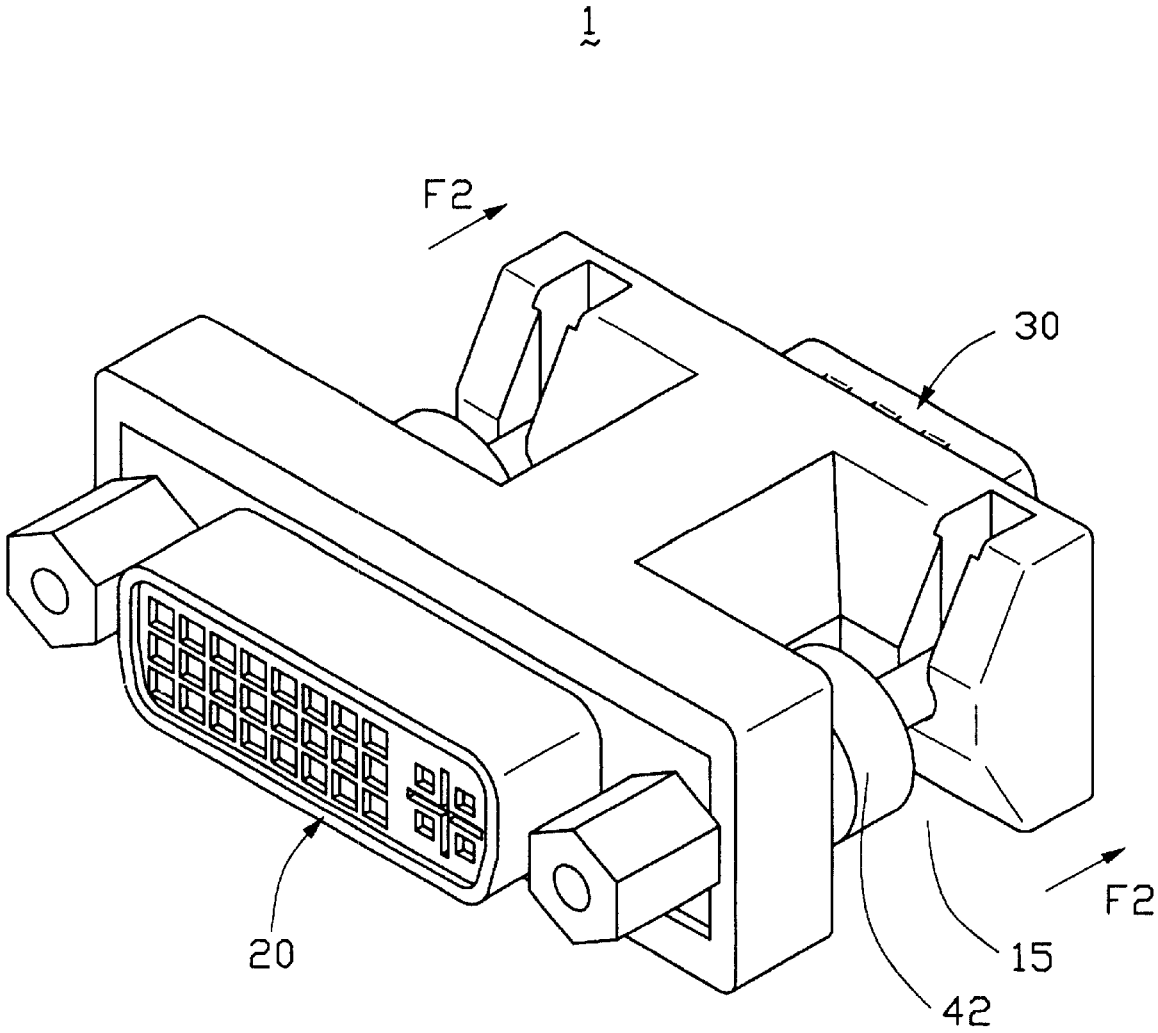
FIG. 3 is an assembled view of FIG. 1, wherein the screw member of the electrical adapter is in a second position.
Figure 4:
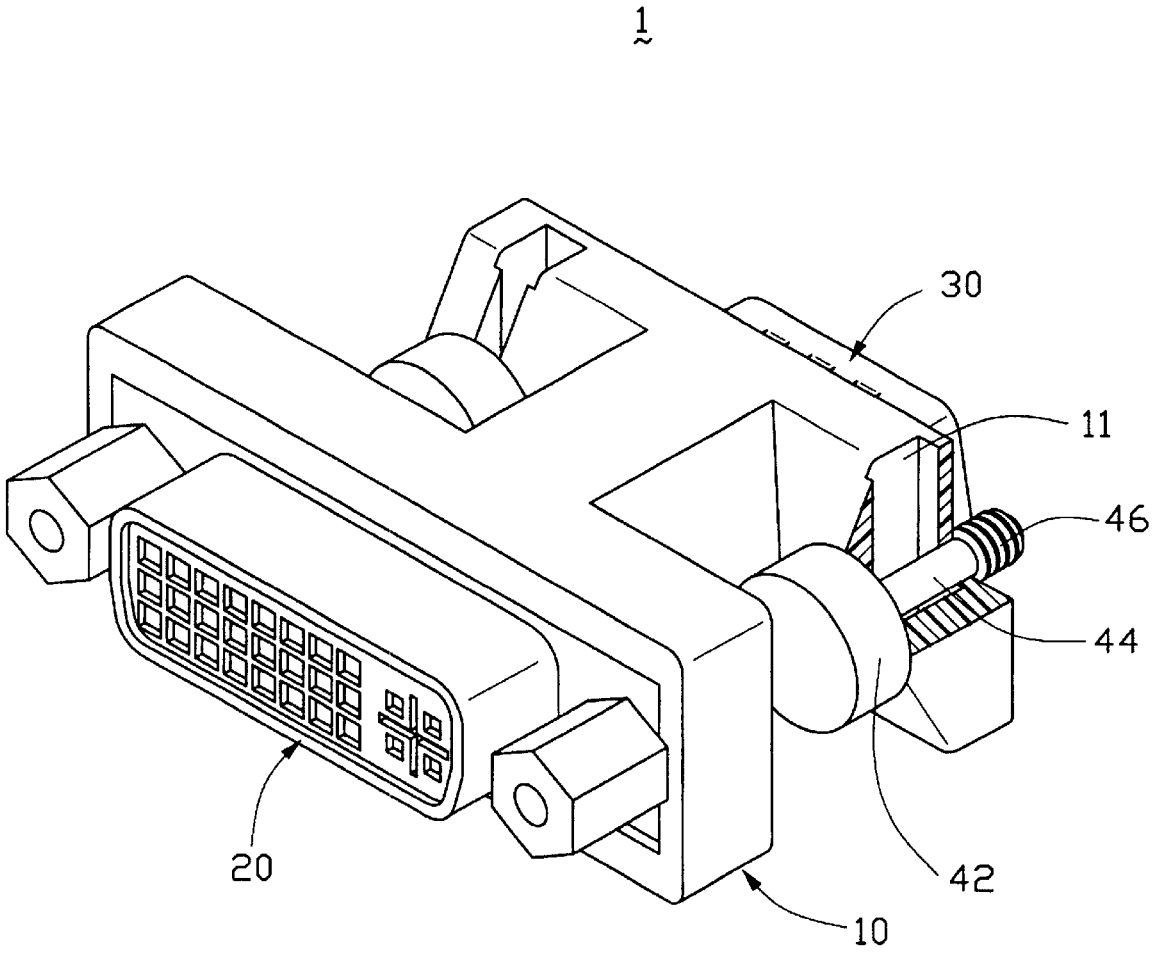
FIG. 4 is an assembled view of FIG. 1, wherein the screw member of the electrical adapter is in a final position.
Figure 5:
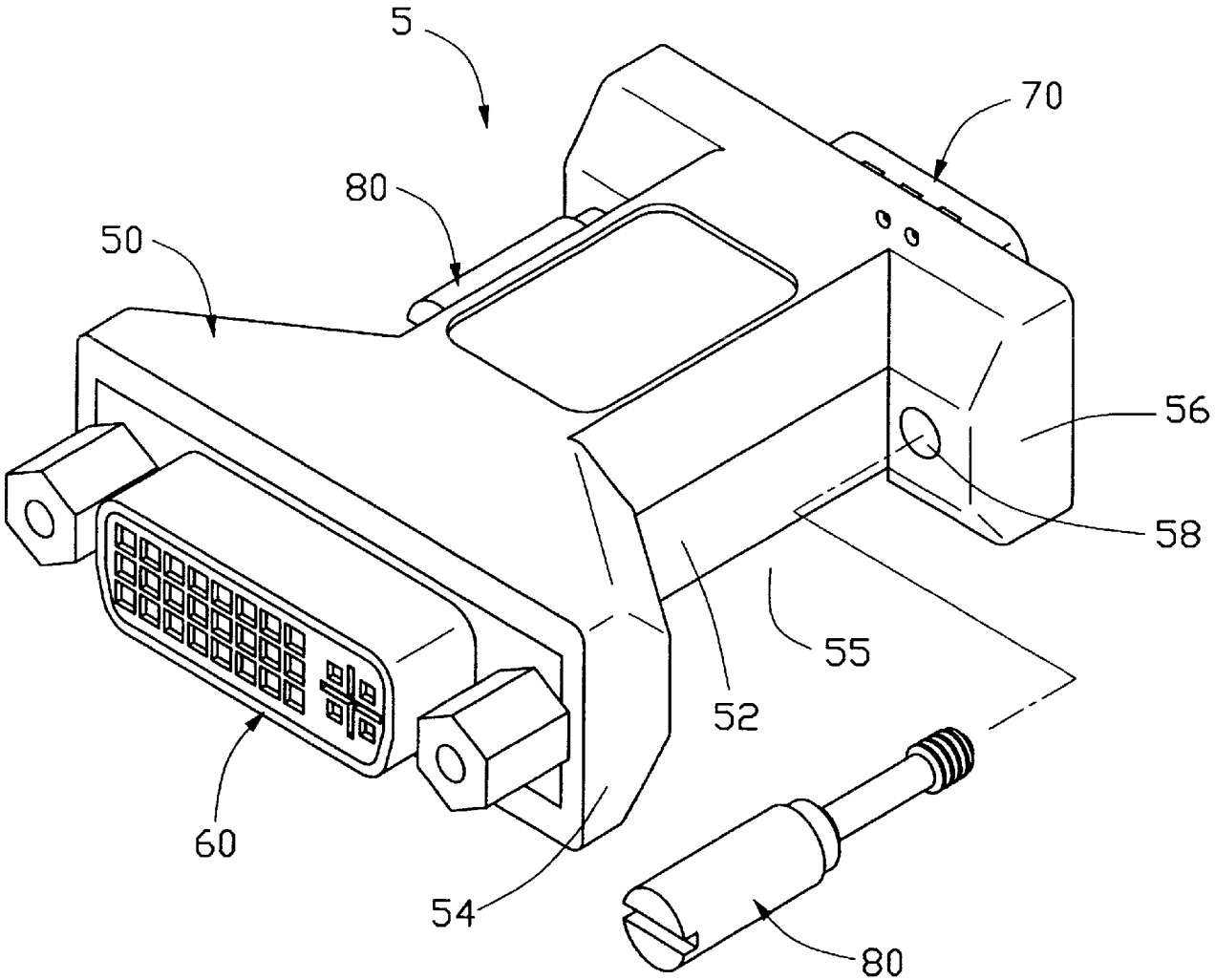
FIG. 5 (PRIOR ART)
FIG. 5 is partial assembled perspective view of a prior art electrical adapter.
Figure 6:
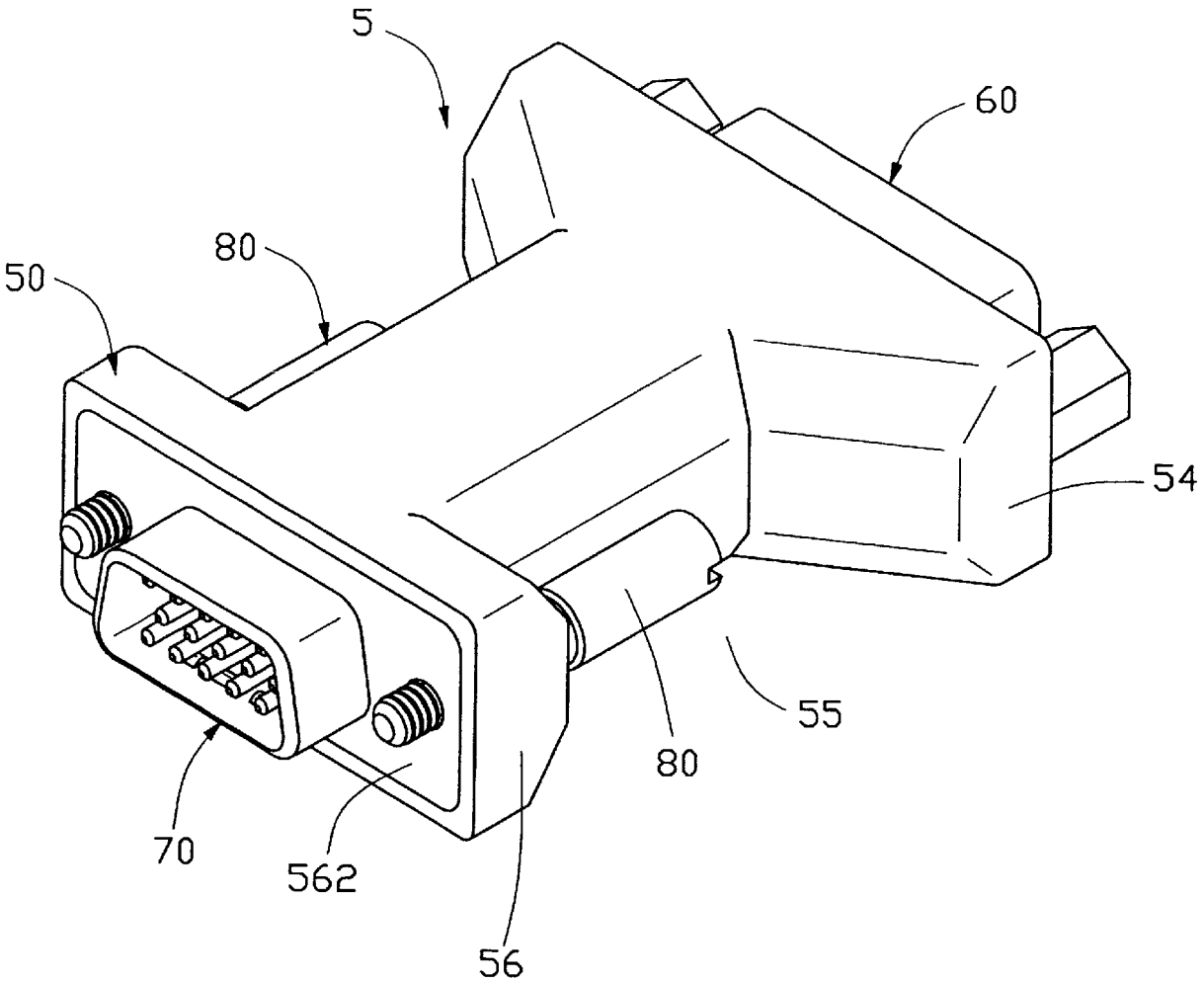
FIG. 6 (PRIOR ART)
FIG. 6 is another assembled view of FIG. 5.

Further referring to FIGS. 2 to 4, the pair of screw members 40 are to be vertically attached to the second pole 16 for interlocking with corresponding nuts (not shown) of the mating connector. The screw member 40 is much simple and shorter with respect to that in the prior art and includes a round cap 42, a threaded portion 46 and a post 44 connected between the round cap 42 and the post 44. As best seen in FIG. 4, the length of the post 44 is substantially equal to that of the through hole 13. The screw member 40 is inserted into a corresponding slot 11 from above of the main body 10 until the round cap 42 thereof is stopped by the top face 162 of the second pole 16. Next, the round cap 42 is pushed toward the first pole 14, indicated by the arrow line F1, until the screw member 40 lies down horizontally in a space 15 defined by the elongate body 12 and the first and second poles 14, 16. Then, the round cap 42 is pushed forward, as designated the arrow line F2, until the round cap 42 is stopped by the inside face 164 of the second pole 16. Additionally, the threaded portion 46 extends through the through hole 13 and beyond the outside surface 166 for engaging with the nut of the mating connector. In this way, the whole size of the electrical adapter 1 can be adjusted according to the structure of the screw member, that is, it is not be substantively limited by structure of the screw member, and smaller structure the screw member 40 has, smaller whole size the electrical adapter 1 can be. Thus, the electrical adapter 1 of the present invention overcomes the disadvantages associated in the prior art and can meet the miniature trend in computers industry.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical adapter comprising:

an insulative housing having opposite first and second poles;

a first electrical connector being connected with the first pole of the housing for engaging with a first mating connector;

a second electrical connector being connected with the second pole of the housing for engaging with a second mating connector, the second pole defining a slot; and a screw member being attached to the slot of the second pole of the housing from above of the insulative housing for interlocking the second mating connector wherein the slot of the second pole is opened to a top face and an inside face of the second pole.

2. The electrical adapter as claimed in claim 1, wherein the insulative housing is substantial "I"-shaped and has a body portion, the first and second poles extending vertically from opposite ends of the body portion and parallel with each other.

3. The electrical adapter as claimed in claim 2, wherein the distance between the first and second poles is substantially equal to a length of the screw member.

4. The electrical adapter as claimed in claim 1, wherein a through hole is defined below and communicating with the slot and extends through opposite inside and outside faces of the second pole.

5. The electrical adapter as claimed in claim 4, wherein the screw members has a round cap, a threaded end portion and a post connected between the round cap and the threaded end portion.

6. The electrical adapter as claimed in claim 5, wherein the post is substantially as long as the through hole.

7. The electrical adapter as claimed in claim 6, wherein the screw member is inserted into the slot from above of the insulative housing until the round cap thereof is stopped by the top face of the second pole, then the round cap is rotated toward the first pole such that the screw member horizontally lies in a space defined by the body portion, the first and second ended portions, and finally, the round cap is pushed such that the threaded end portion of the post extends through the through hole and beyond the outside face of the second pole.

8. A method for assembling a screw member with an adapter which includes a dielectric body having opposite poles, a first electrical connector and a second electrical connector attached to the opposite poles, respectively, the method comprising steps of:

providing one of the opposite poles with a slot opened in a top face and a side face thereof, and a through hole below and communicating with the slot;

inserting the screw member from above of the dielectric body into the slot;

rotating the screw member toward another pole opposite to lie the screw member down; and pushing the screw member forward to extend beyond another opposite side face of the one of the opposite poles.

9. An electrical connector device comprising:

an insulative housing defining a mating portion in a front-to-back direction;

a through hole extending horizontally through said housing along said front-to-back direction;

a vertical slot downwardly extend from a top face of the housing toward and reaches said through hole, said vertical slot further extending toward and through an inside face of the housing so as to form a planar communication with said through hole; and a screw member defining a post with a cap and a threaded portion at two opposite ends thereof; wherein the screw member is inserted into the housing first with the post and the threaded portion, except the cap, extending into the vertical slot in a downward direction; said screw member further rotates about an intersection of said through hole and said slot to have the post sweep pivotally downwardly to reach the through hole and be ready to move in said front-to-back direction.

10. The connector device as claimed in claim 9, wherein said cap is located outside said through hole when said screw member is received within the through hole.

11. The connector device as claimed in claim 9, wherein said vertical slot forms a step therein to define a narrowed space for regulating the screw member to be inserted into slot in said downward direction.

12. The connector device as claimed in claim 9, wherein said vertical slot is dimensioned with portions narrower than the through hole for retaining the screw member in the through hole without upwardly moving.

* * * * *